United States Patent [19]

Felsenthal et al.

[11] Patent Number: 4,688,671

[45] Date of Patent: Aug. 25, 1987

[54] GARMENT BAG ADAPTED FOR USE WITH VENTILATED SHELVING

[75] Inventors: Donald Felsenthal; Max Schachter, both of Memphis, Tenn.

[73] Assignee: Whitmor Manufacturing Co., Inc., Earle, Ark.

[21] Appl. No.: 928,048

[22] Filed: Nov. 7, 1986

[51] Int. Cl.[4] ..... B65D 85/18

[52] U.S. Cl. ..... 206/279; 206/280; 206/287

[58] Field of Search ..... 206/278, 280, 291, 279

[56] References Cited

U.S. PATENT DOCUMENTS

| | | | |
|---|---|---|---|
| 1,700,879 | 2/1929 | Boch | 206/287 |
| 2,351,882 | 6/1944 | Schwartzman | 206/287 |
| 2,372,439 | 3/1945 | Lofgren | 206/287 |
| 4,236,634 | 12/1980 | Benedict | 206/287 |

FOREIGN PATENT DOCUMENTS

| | | | |
|---|---|---|---|
| 35982 | 5/1926 | Denmark | 206/287 |
| 792279 | 10/1935 | France | 206/289 |
| 1088139 | 9/1954 | France | 206/287 |
| 1089692 | 10/1954 | France | 206/286 |
| 163895 | 6/1921 | United Kingdom | 206/278 |

*Primary Examiner*—William Price

*Attorney, Agent, or Firm*—Peter J. Georges

[57] ABSTRACT

An over-the-rod garment bag adapted for use with ventilated metal shelving is described. Ventilated metal shelving is comprised of a relatively thin wire clothing rod that is supported along its length by a plurality of upwardly extending support rods. The described clothing bag has a top with a transverse split extending across the middle thereof. At the split, hook and loop sealing means allow for sealing at location(s) where the rods supporting the clothing rod extend upwardly through the top of the clothing bag. Also on each side of the garment bag, a universal sealing element comprised of radially extending score lines adaptable for use with either ventilated metal shelving or other types of clothing rod closet arrangements is described.

7 Claims, 4 Drawing Figures

FIG. 1
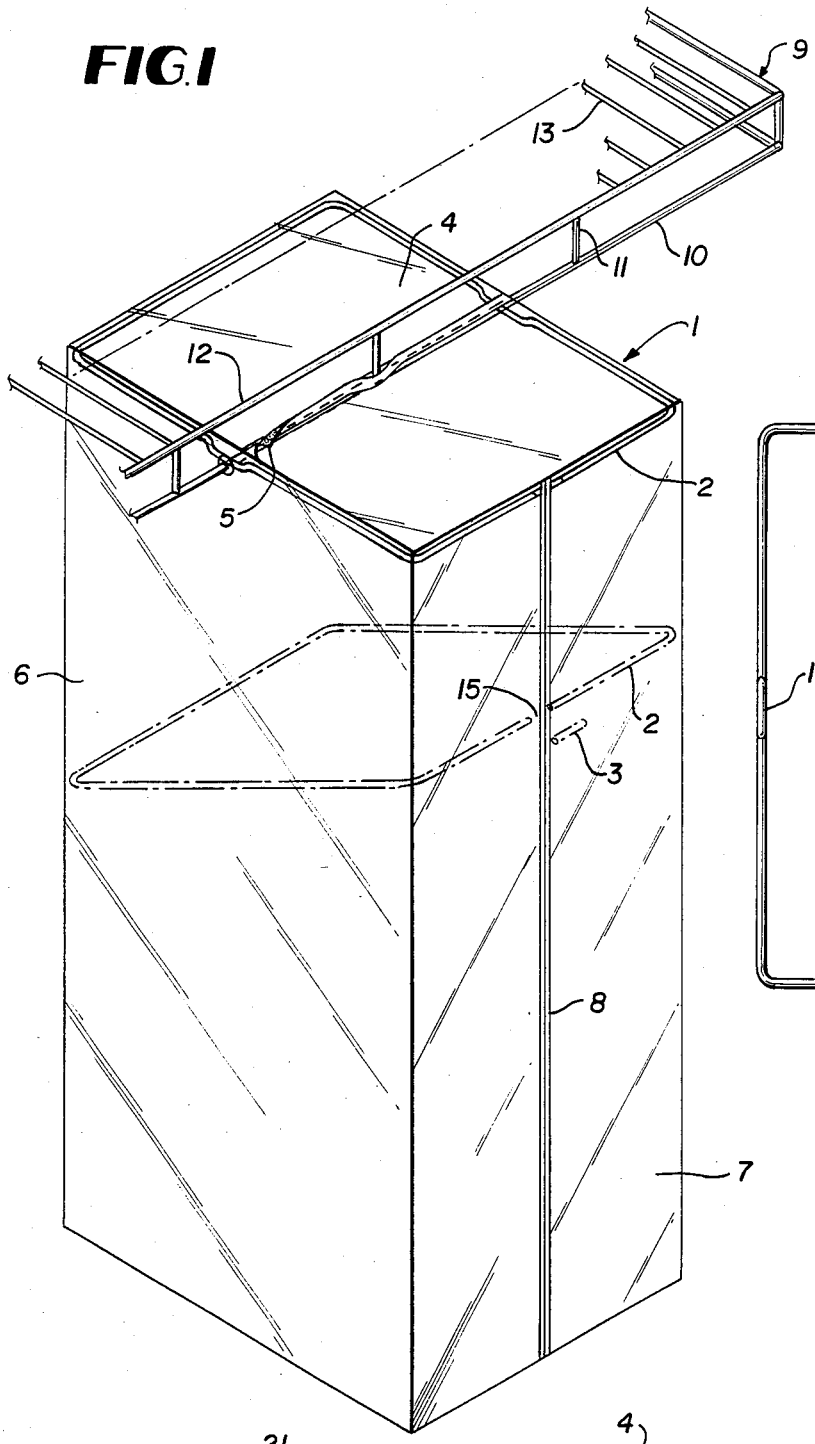
FIG. 2
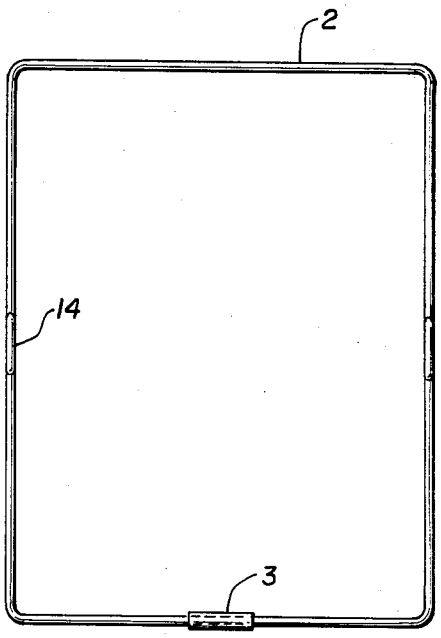
FIG. 3
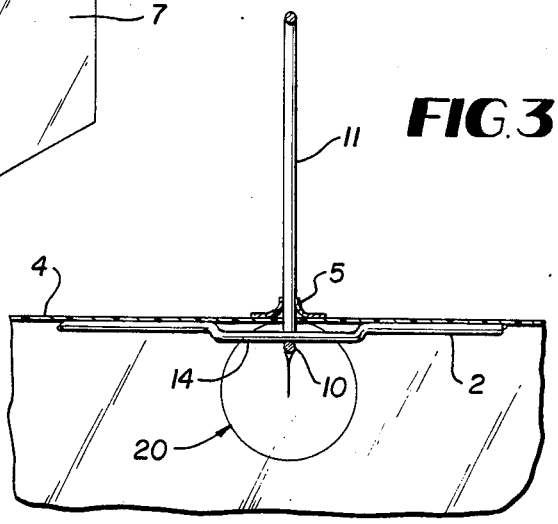
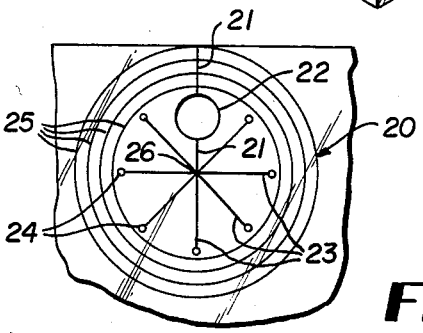
FIG. 4

GARMENT BAG ADAPTED FOR USE WITH VENTILATED SHELVING

FIELD OF THE INVENTION

The invention relates to an over-the-rod garment bag adapted for use with ventilated metal shelving. The clothing rods of this type of metal shelving are made of wire of relatively small diameter. The clothing rods are supported along their length by a plurality of upwardly extending supporting rods. The supporting rods are spaced at intervals which are less than the width ordinarily used for clothing bags.

The construction of the garment bag of the present invention enables it to be used with ventilated metal shelving as well as with other typical closet rod arrangements where the clothing rod is supported on either end and is of substantially larger crosssection than the clothing rods used in ventilated metal shelving.

The garment bag is internally reinforced at the top by a rectangular frame adapted for over-the-rod placement. The top panel of the garment bag has a transverse split extending across the middle thereof. The clothing rod is passed through this split. The top panel is then sealed above the rod using a hook and loop tape sealing means. Use of this type of closure means allows for sealing at the location(s) where support rods for the clothing rod extend upwardly through the top of the clothing bag.

Along either side of the garment bag, a universal sealing element adaptable for use with either ventilated metal shelving or other types of clothing rods is provided.

DESCRIPTION OF THE PRIOR ART

The Over-The-Rod Storage Bag Art

Numerous types of over-the-rod garment storage bags/containers comprising a frame for supporting the top of the bag above a clothing pole have previously been used for clothing storage.

Examples of patents describing such garment bags are U.S. Pat. Nos. 1,700,879; 2,351,882; 2,372,439 and 4,236,634.

In the two earliest patents, U.S. Pat. Nos. 1,700,879 and 2,351,882, the top of the garment wall is split transversely across the middle to permit the clothing rod, a pole, to pass downwardly through the top of the garment bag. Along either side of the garment bags of the art, notches, hook and loop closure means, drawstring arrangements, etc. have been used to accommodate clothing rods. Sidepanels/sidewalls in general use in over-the-rod garment bags are illustrated by reference to the above-identified prior art patents.

The Ventilated Metal Closet Shelf Art

Ventilated metal closet shelves have been very popular for some time and there is a continuing need for a simple inexpensive garment bag adapted for use with (1) the typical horizontal clothing rods; that is, rods of about a ¾" or greater cross-section; supported at both ends and unobstructed along their lengths; and, (2) also with metal closet shelves in which the forward vertical edge of the shelving is comprised of a wire clothing rod, supported along its length by a plurality of vertical supporting rods. The latter type of shelving is of the type described in U.S. Pat. Nos. 3,598,064 and 4,316,593.

SUMMARY OF THE INVENTION

One object of the present invention is to provide a garment bag that can be readily interfitted over an extended length of ventilated shelving metal clothing rods.

Another object of the invention is to provide a garment bag adapted for universal use with all types of clothing rods.

Yet another object of the invention is to provide an inexpensive and facile arrangement for reinforcement, attachment and closure of the clothing bag that is adapted for use with ventilated metal shelving clothing rods.

A further object is to provide a simple and inexpensive universal closure means for the sidewalls of over-the-rod garment bags suitable for use with both over-the-rod garment bags for ventilated metal closet shelving and with closet rods of cross-sections substantially larger than the wire clothing rods of ventilated shelving.

In one of its broadest aspects, the present invention relates to an improvement over predecessor over-the-rod garment bags. Such bags comprise a top panel with a transverse split extending across the middle thereof and downwardly extending side panels integral with the sides of the top panel. The side panels each have an opening through which a clothing rod can be extended when the rod is inserted below the top panel. The improvement of the present invention involves the use of side panel opening means on each side panel that accommodate rods of varying cross-section. The side panel opening means comprise a radially scored plastic side panel section, with a first radial score line extending from a center point in a direction normal to the transverse split and terminating at the edge of the side panel integral with the top panel. An opening is centered on the score line. The opening may suitably be circular since the wire clothing rods of ventilated shelving are generally of circular cross-section. The opening is sized and located to allow a wire clothing rod of a wire shelf system to pass therethrough when the score line between the opening and the terminus of the transverse split is torn and the garment bag is suspended on the wire clothing rod. A plurality of other radial score lines, in addition to the first radial score line, radiate outwardly from the point on which the first radial score line is centered. These other score lines terminate remote from any edge of the side panel; that is, the other score lines do not extend to any of the edges of the side panel as is the case with the first radial score line. The other score lines are of a size and number such that when the first radial score line is torn along its entire length and the side panel portion is torn along one or more of these other score lines, a clothing rod of larger cross-section than the opening on the first radial score line can be accommodated.

The side panels of the over-the-rod garment bag are suitably made of clear plastic or a colored and/or quilted fabric, suitably also plastic. The scored side panel section is also preferably plastic, most preferably reinforced by means of an added plastic ply. The reinforcing ply is generally affixed to the side panel by heat sealing. Heat seals located remote from the center point adjacent the terminus of each of the radial score lines other than the first radial score line serve to prevent the other score lines from being torn beyond the designated terminus of the score lines.

Another embodiment of the invention relates to an over-the-rod garment bag comprised of (1) a top panel for accommodating a clothing rod and (2) side panels, each with openings through which said clothing rod can be passed. In this embodiment of the invention, the garment bag comprises a top panel supporting wire frame extending the perimeter of the top panel. The wire frame has indentations on the two opposite sides thereof which extend along the side panels. The indentations orient and support the wire frame on top of a clothing rod on which they are rested and allow a clearance for placement of hangers on the wire clothing rods. The wire frame is separable at a locus remote from the point where the wire frame, when supported on said clothing rod, comes into contact with the clothing rod. The wire frame, therefore, can be separated to allow one or more vertical clothing rod support bars to be passed through its perimeter into the frame perimeter. A flexible top panel with a transverse split extending completely across its middle, comprising two sections having hook and loop closure means situated in overlapping relationship at the transverse split, forms a closure around support rods that extend vertically upward through the top panel when the over-the-rod garment bag is in place and secured over the clothing rod of a ventilated metal shelf. There are side panel opening means for each of the side panels of the garment bag for passing the clothing rod through the side panels.

BRIEF DESCRIPTION OF THE DRAWINGS

The description here makes reference to the accompanying drawings wherein like reference numbers relate to like parts throughout the several views, and wherein:

FIG. 1 is a perspective view of the garment bag of the present invention suspended from ventilated wire closet shelving;

FIG. 2 is a top view of the top panel supporting wire frame;

FIG. 3 is a cutaway side view illustrating (1) the manner in which the garment bag is supported on the wire clothing rod of a ventilated wire shelving and (2) the means of closure around a vertical supporting rod extending upwardly from the wire clothing rod through the top panel of the garment bag; and, FIG. 4 is a close-up side view of the scored side panel section of the garment bag through which clothing rods of varying size can be accommodated.

DESCRIPTION OF THE PREFERRED EMBODIMENT

Referring to the drawings, in FIG. 1 the over-the-rod garment bag 1 of the present invention is shown resting on/suspended from the wire clothing rod 10 of ventilated metal shelving 9. The garment bag assembly 1 comprises top panel 4, side panel 6, a front panel 7, with a means for access to the bag 8, suitably a zipper running down substantially the entire length of the front panel.

The bag is suspended from a metal clothing rod 10 which is supported along its length by vertical support bars 11. The vertical support bars 11 extend upwardly and are affixed to another rod 12 running parallel to clothing rod 10. Rods 10 and 12 may be of the same or different diameter/cross-section; they define the forward vertical edge of the shelving. The metal shelving is further comprised of a plurality of parallel shelf forming support rods 13, which are affixed to rod 12 as shown in FIG. 1. The ventilated metal shelving shown in part in FIG. 1 is representative of typical wire shelving now widely in use and referred to in the trade as ventilated metal shelving.

As further illustrated in FIG. 1, the top panel is split transversely. Hook and loop "Velcro" fastening means are situated along said split 5 whereby the top panel split 5 can be completely opened to allow clothing rod 10 to be placed within the garment bag and then the split 5 can be closed along its length with provision for closure around any vertical support rod extending upwardly through and along the length of the split.

Also shown in FIG. 1 is a wire frame 2 which has an opening 15 that can be closed by interfitting the two ends of the frame which define opening 15 within a cylinder having a diameter such that a tight fit around the portions of the frame are secured within cylinder 3. The cylinder may be metal, suitably of the same type as used for the frame; alternatively, other suitable materials, such as plastics and/or reinforced plastic materials, may be used for one or the other of the frame and frame opening/closing means 3. Other means of separating and securing frame 2 may be used; however, the simple arrangement illustrated has been found to be adequate for this purpose.

As best shown by reference to FIGS. 2 and 3, frame 2 has a notch/indented portion 14, which rests on the clothing rod 10. As also shown in FIG. 3, the "Velcro" sealable transverse split of the top panel is a particularly suitable means of sealing the top panel 4 of the over-the-rod garment bag of the present invention; this, because, the use of hook and loop closure means accommodates vertical support members which pass through the panel top and forms an effective seal around them.

The scored side panel section shown generally at 20 of FIG. 3, is best illustrated by reference to FIG. 4. The side panels 6 of garment bag 1, inclusive of the scored portion 20, suitably may be made of clear plastic. The scored portion 20 may be made by securing a second ply of clear plastic to the side panels at appropriate locations. Circular heat impressed seals, indicated generally at 25, may be used for this purpose.

Scored side panel section 20 comprises a number of score lines, suitably equidistant from one another radiating out from a central point 26. One score line 21 terminates at the edge of the top panel where one end the transverse split terminates. Accordingly, prior to use, the score line between opening 22 and the top panel edge where the transverse split ends, must be separated/torn to allow any clothing rod/pole over which the bag is rested to be placed below the top panel.

It is generally advisable that the portion of score line 21 between the opening 22 and the edges of the side panel is readily torn/separated. This section of score line 21 is always torn in order to accommodate the placement of a clothing rod below top panel 4, whether the wire rod is of small diameter as in ventilated shelving or large diameter as in the case with most closets using wooden clothing poles.

The radial score lines other than radial score line 21, namely, score lines 23, as shown by reference to FIG. 4, do not extend as far as the edge of the scored side panel and they terminate at heat seals denoted 24 which serve to prevent tearing from occurring beyond the score line. Depending on the size of the clothing rod/pole, one or more of the radial score lines 23 other than 21 can be torn to accommodate the rod/pole.

The opening for the wire clothing rod remains open when a larger clothing rod is passed through the side panel plastic section after tearing one or more of the other radial score lines; however, the opening, which is of relatively small cross-section, is not so large that the passage of dust therethrough creates a problem. Indeed, if desired, a flap (not shown) can be used over said hole whereby, when the rod passing through the side panel section is larger than the opening centered on the score line, the flap operates to cover at least a portion of the opening.

Most preferably, the length of each of the radial score lines, other than score line 21, is about $\frac{3}{4}'' \pm \frac{1}{4}''$. In this way, when all the score lines are torn and the standard closet pole is placed so that the center of the cross-section thereof is located substantially at point 26 and the flaps formed by the score line are splayed out from the garment bag side panel, resting on the pole; then, a satisfactory closure around the rod is formed and opening 22 is substantially sealed by the pole.

The instant invention has been shown and described herein in what is considered to be the most practical and preferred embodiment. It is recognized, however, that departures may be made therefrom within the scope of the invention and that obvious modifications will occur to a person skilled in the art.

We claim:

1. In an over-the-rod garment bag comprising a top panel with a transverse split extending across the middle thereof and downwardly extending side panels integral with the sides of the top panel, said side panels each having an opening through which a clothing rod can extend when inserted below the top panel, the improvement which comprises side panel opening means adaptable for use with rods of varying cross-section, said side panel opening means comprising a radially scored plastic side panel section, with a first radial score line extending from a center point in a direction normal to the transverse split and terminating at the edge of the side panel integral with the top panel; an opening centered on said first radial score line of a size and location to allow a wire clothing rod of a wire shelf system to pass therethrough when the score line between said opening and the terminus of the transverse split is torn and the garment bag is suspended on said wire clothing rod; and, a plurality of other radial score lines, in addition to the first radial score line, said other radial score lines radiating outwardly from the same center point as said first radial score line, said other score lines terminating remote from any edge of the side panel, said other score lines being of a size and number to allow a clothing rod of a cross-section larger than the cross-section of the opening centered on the first score line to pass therethrough when the first radial score line is torn along its entire length and the radially scored plastic side panel portion is torn along one or more of said other radial score lines.

2. The over-the-rod garment bag of claim 1 wherein the side panels are plastic and the scored plastic side panel section is reinforced using an added plastic ply.

3. The over-the-rod garment bag of claim 2 wherein the reinforcing ply is affixed by heat sealing, with heat seals located remote from the center point adjacent the terminus of each of said other radial score lines.

4. An over-the-rod garment bag comprised of (1) a top panel for accommodating a clothing rod and (2) side panels, each with openings through which said clothing rod can be passed, which comprises:

(a) a rectangular shaped top panel supporting wire frame extending the perimeter of the top panel, said wire frame having indentations on the two opposite sides thereof adjacent the side panels for orienting and supporting the wire frame on top of a clothing rod, said wire frame being separable at a locus remote from the point where said wire frame, when supported on said clothing rod, comes in contact therewith, whereby said wire frame can be separated to accommodate one or more vertical support bars within the perimeter thereof; and, (b) said top panel comprising a flexible rectangular panel with a transverse split extending completely across the middle thereof, said flexible top panel comprising two sections comprising hook and loop closure means situated in overlapping relationship at said transverse split to form a closure around any support rods extending vertically upward through the top panel; and (c) side panel opening means for each of said panels for passing the clothing rod therethrough.

5. The over-the-rod garment bag of claim 4 wherein the side panel opening means on each of said side panels comprises a radially scored plastic side panel section, with a first radial score line extending from a center point in a direction normal to the transverse split and terminating at the edge of the side panel integral with the top panel; an opening centered on said first radial score line of a size and location to allow a wire clothing rod of a wire shelf system to pass therethrough when the score line between said opening and the terminus of the transverse split is torn and the garment bag is suspended on said wire clothing rod; and, a plurality of other radial score lines, in addition to the first radial score line, said other radial score lines radiating outwardly from the same center point as said first radial score line, said other score lines terminating remote from any edge of the side panel, said other score lines being of a size and number to allow a clothing rod of a cross-section larger than the cross-section of the opening centered on the first score line to pass therethrough when the first radial score line is torn along its entire length and the radially scored plastic side panel portion is torn along one or more of said other radial score lines.

6. The over-the-rod garment bag of claim 5 wherein the side panels are plastic and the scored plastic side panel section is reinforced using an added plastic ply.

7. The over-the-rod garment bag of claim 6 wherein the reinforcing ply is affixed by heat sealing, with heat seals located remote from the center point adjacent the terminus of each of the other radial score lines.

* * * * *